US006379077B1

(12) United States Patent
Camber et al.

(10) Patent No.: US 6,379,077 B1
(45) Date of Patent: Apr. 30, 2002

(54) DEVICE FOR JOINING TWO CONCRETE MEMBERS TOGETHER

(75) Inventors: Peter Geoffrey Camber, Tarporley; Norman Stanley Thomas, Market Drayton, both of (GB)

(73) Assignee: C. V. Buchan Ltd., Cheshire (GB)

( * ) Notice: Subject to any disclaimer, the term of this patent is extended or adjusted under 35 U.S.C. 154(b) by 0 days.

(21) Appl. No.: 09/582,532

(22) PCT Filed: Jan. 25, 1999

(86) PCT No.: PCT/GB99/00257

§ 371 Date: Sep. 5, 2000

§ 102(e) Date: Sep. 5, 2000

(87) PCT Pub. No.: WO99/39081

PCT Pub. Date: Aug. 5, 1999

(30) Foreign Application Priority Data

Jan. 29, 1998 (GB) ..... 9801926

(51) Int. Cl.[7] ..... E21D 11/08

(52) U.S. Cl. ..... 403/367; 24/618; 24/697.1; 52/587.1; 405/153

(58) Field of Search ..... 405/135, 153; 52/582.1, 587.1; 24/618, 697.1, 701; 403/230, 292, 294, 315, 317, 365, 366, 367

(56) References Cited

U.S. PATENT DOCUMENTS

| | | | | | |
|---|---|---|---|---|---|
| 1,278,134 | A | * | 9/1918 | Gardner | 24/701 X |
| 5,097,643 | A | * | 3/1992 | Wittler | 52/587.1 X |
| 5,251,996 | A | * | 10/1993 | Hiller et al. | 52/582.1 X |
| 5,771,650 | A | * | 6/1998 | Williams et al. | 403/292 X |
| 5,970,675 | A | * | 10/1999 | Schray | 52/582.1 |
| 6,076,995 | A | * | 6/2000 | Tauchi et al. | 405/153 |

FOREIGN PATENT DOCUMENTS

| | | |
|---|---|---|
| DE | 8533059 | 5/1987 |
| EP | 0317220 | 5/1989 |
| EP | 0651135 | 5/1995 |
| GB | 2092644 | 8/1982 |
| JP | 08232584 | 9/1996 |
| JP | 09242483 | 9/1997 |
| JP | 10131306 | 5/1998 |
| JP | 10140988 | 5/1998 |
| JP | 10176494 | 6/1998 |
| WO | 9803773 | 1/1998 |

OTHER PUBLICATIONS

Sweet's General Building & Renovation 1995 Catalog File, vol. 2, New York, McGraw Hill Inc, Mar. 1995, p. 03250/HEC. TH 455.S87.*

Abstract Patent Abstract of JP–A–10131306, filed Jun. 11, 1996.

* cited by examiner

*Primary Examiner*—Lynne H. Browne
*Assistant Examiner*—Greg Binda
(74) *Attorney, Agent, or Firm*—Merchant & Gould P.C.

(57) ABSTRACT

A device for joining two concrete members together, such as concrete tunnel or shaft lining segments (1, 2) includes at least one elastic female member (6) anchored in one of the segments and at least one elastic male member (7) anchored in the other of the segment to be joined. The female members (6) are provided with recesses (6A) to receive heads (7A) of the male members (7), each female member (6) being slotted at 6B to receive a respective web (7B) of the male members (7) and is undercut at 6C to receive the head (7A). At least one of the male and female members has a sloping engagement face (8, 9) to provide wedging action by acting to draw the head of the male member further into the female member as the web of the male member is moved along the slot.

12 Claims, 6 Drawing Sheets

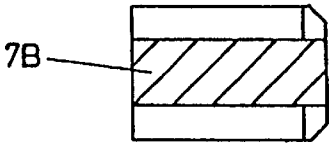
FIG. 7B
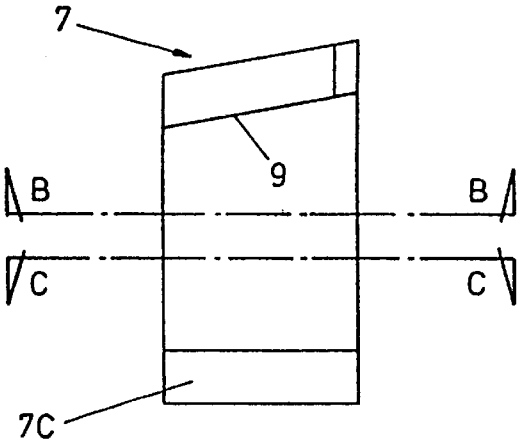
FIG. 7A
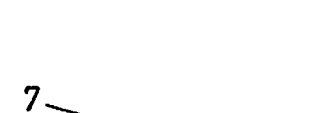
FIG. 7C
FIG. 7D
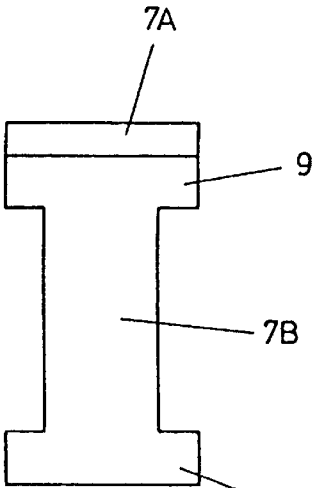
FIG. 7E

DEVICE FOR JOINING TWO CONCRETE MEMBERS TOGETHER

BACKGROUND OF THE INVENTION

This invention relates to a device for joining two concrete members together.

One such device for joining two concrete members together is disclosed in EP-A-0 651 135, where two sleeves are cast-in respective concrete segments and a ribbed connecting member in one of the sleeves is forced into the other sleeve and is wedged therein by means of an interaction between sloping ribs. Another such device is known from JP 10131306-A.

SUMMARY OF THE INVENTION

According to one aspect of the present invention, there is provided a device for joining two concrete members together, the device comprising a female member for anchoring in one of the concrete members to open at a surface thereof and a male member for anchoring in the other of the concrete members, the female member being slotted and undercut and the male member having a head for mating with the female member in its undercut so as to be held therein by a wedging action. The female member is of elastic material and the male member is of elastic material and the head is joined by a web to a body for anchoring the male member, the web being able to slide in the slot and the head being engageable with the female member in its undercut and at least one of the male and female members has a sloping engagement face to provide the wedging action by acting to draw the head further into the female member as the web is moved along the slot.

The members can be concrete segments for forming, for example, a tunnel lining ring or shaft.

According to another aspect of the present invention, there is provided a concrete segment joining system comprising two segment members and a device essentially as just defined for joining the two segment members together.

The male and female members can be made from a high grade elastic polymer material.

Both the male and female members may be provided with the sloping engagement faces to provide the wedging action between them.

The female member may be provided adjacent its slot with an opening to receive the head of the male member so that the head of the male member may be received in the undercut of the female member.

The sloping engagement face on the female member can extend from one end of the slot to the other, increasing in height of slope from an entry end of the slot towards the other end of the slot.

If the male member is provided with the sloping engagement face, this sloping engagement face can increase in height from one side of the male member that is intended to enter the undercut of the female member first towards the other side of the male member.

The female member may be shaped as a double-entry member for the male member. In other words, the female member can be provided with an opening at each end of its slot so as to receive the male member in its undercut from either end of the slot. If the female member is provided with the sloping engagement face, then it is ramped, rising from both ends of the slot, with a flat central land.

The male member may be shaped as a complementary double-entry member for the female member and can be provided with a sloping engagement face that is ramped with a flat central land.

BRIEF DESCRIPTION OF THE DRAWINGS

For a better understanding of the invention and to show how the same may be carried into effect, reference will now be made, by way of example, to the accompanying drawings, in which:

FIG. 7A is a side view of the male member, FIG. 7B is a sectional view along the line B—B of FIG. 7A, FIG. 7C is a sectional view along the line C—C of FIG. 7A, FIG. 7D is a view of one end of the male member, FIG. 7E is a view of the other end of the male member.

DESCRIPTION OF THE PREFERRED EMBODIMENTS

Figure 1:
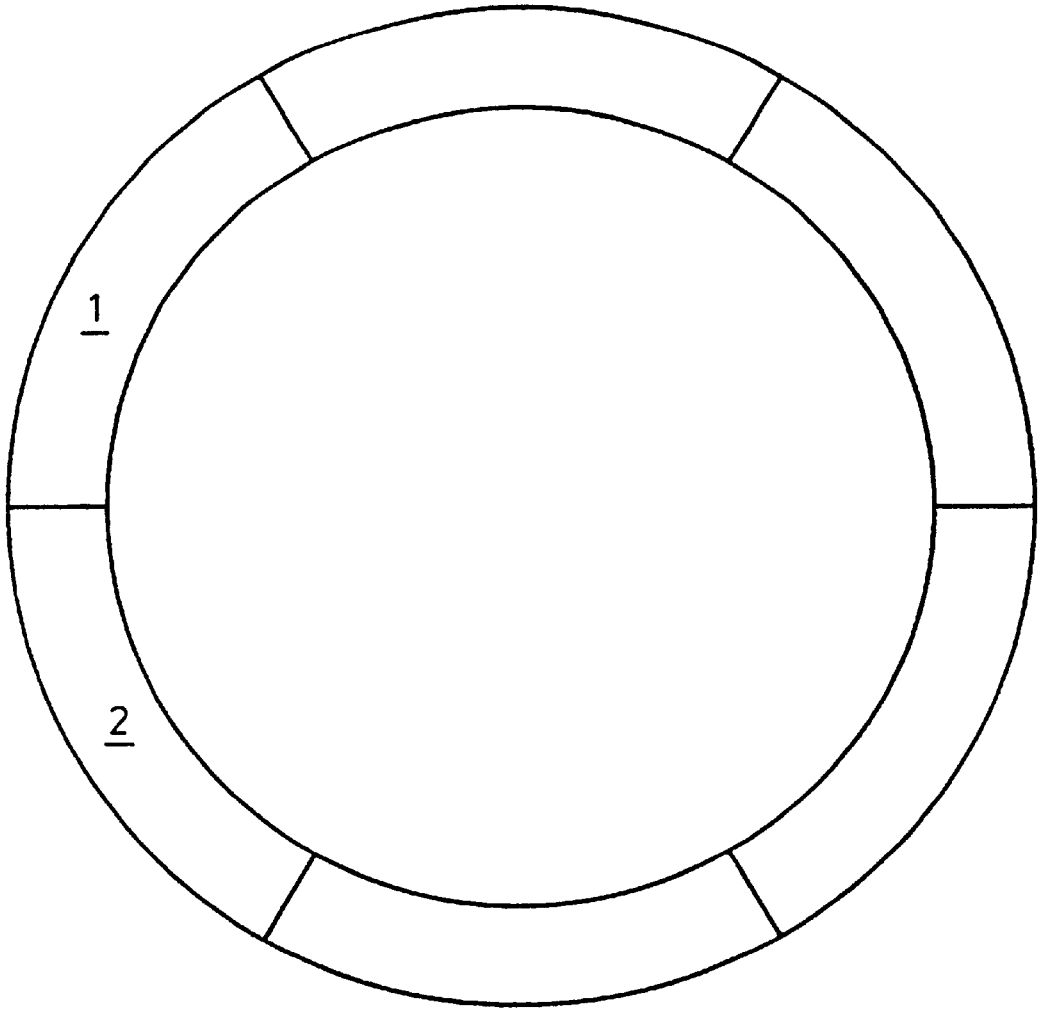
FIG. 1 is a diagrammatic view of a tunnel lining ring formed of concrete segments joined together.

FIG. 1 shows a tunnel or shaft lining ring made up of concrete segments joined together, including segments 1 and 2.

Figure 2:
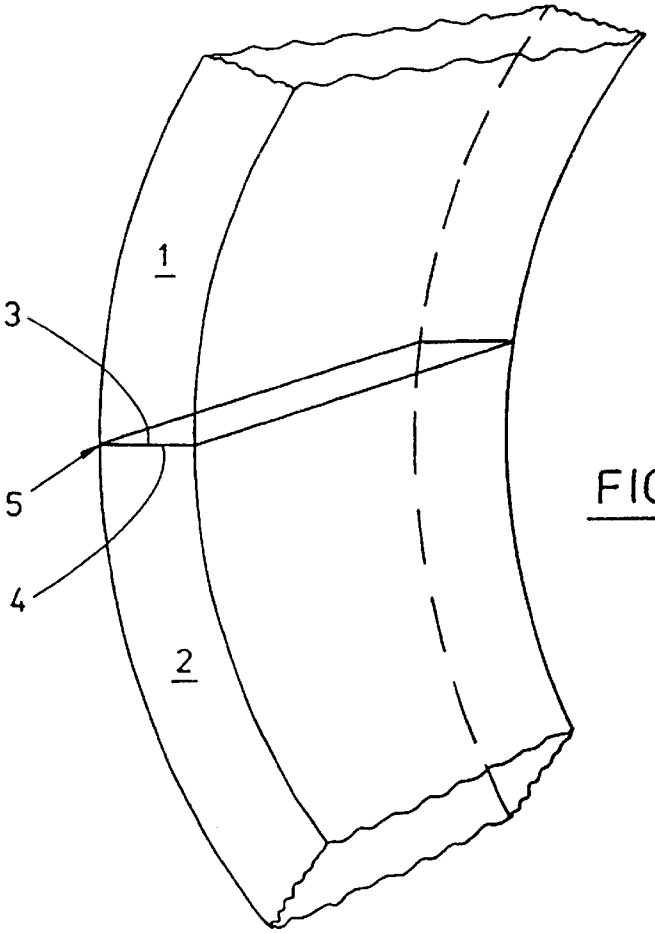
FIG. 2 is a diagrammatic perspective view of a part of two of the segments shown in FIG. 1.

As shown in FIG. 2, edge faces 3 and 4 of the segments 1 and 2, respectively, lie adjacent one another and are joined at a joint 5.

Figure 3A:
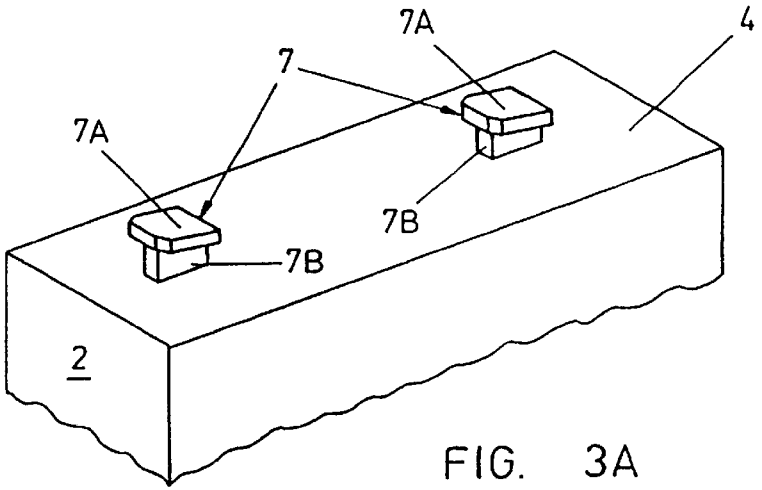
FIG. 3A is a diagrammatic perspective view of the region of an end face of one of the segments shown in FIG. 2, to illustrate two male members of a device for joining the two segments together.
Figure 3B:
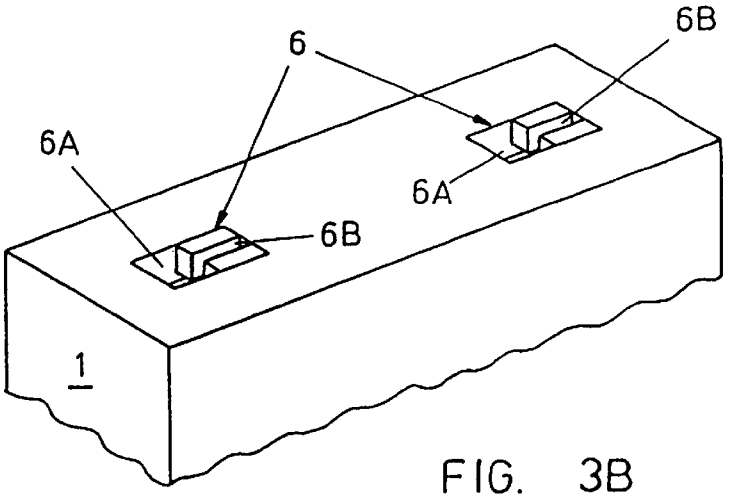
FIG. 3B is a similar view to FIG. 3A but showing two female members of the device, FIGS. 3A and FIG. 3B showing the two segments prior to joining.

As shown in FIGS. 3A and 3B, the joint 5 is provided by a device for joining the two segments 1, 2 together, the device comprising a female member 6 (two being shown in FIG. 3B) anchored in the segment 1 and a male member 7 of which two are shown in FIG. 3A, anchored in the segment 2. The segment 1 is shown inverted and turned through 180° in FIG. 3B.

The female members 6 are cast in the face 3 of the segment 1 to open at the face 3, whilst the male members 7 are cast in the face 4 of the segment 2 so as to be anchored therein and to stand proud thereof. In the form illustrated approximately one-third of each male member 7 stands proud of the face 4.

The female members 6 are each provided with recesses 6A to receive heads 7A of the male members 7, the heads 7A being connected by webs 7B to a body 7C (FIG. 7) anchored in the segment 2.

Figure 6A:
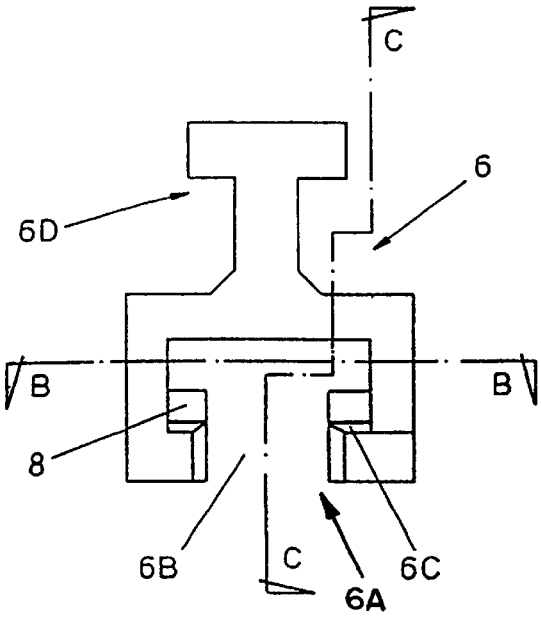
FIG. 6A is an end view of the female member.
Figure 6C:
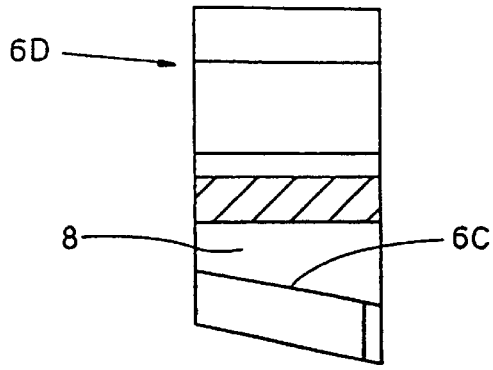
FIG. 6C is a sectional view along the line C—C of FIG. 6A.
Figure 6B:
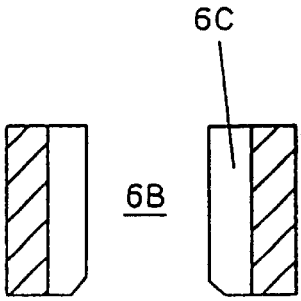
FIG. 6B is a sectional view taken along the line B—B of FIG. 6A.
Figure 8A:
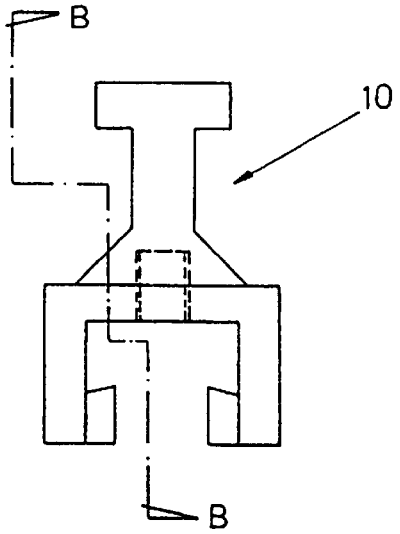
FIG. 8A is an end view of an alternative form of female member.
Figure 8B:
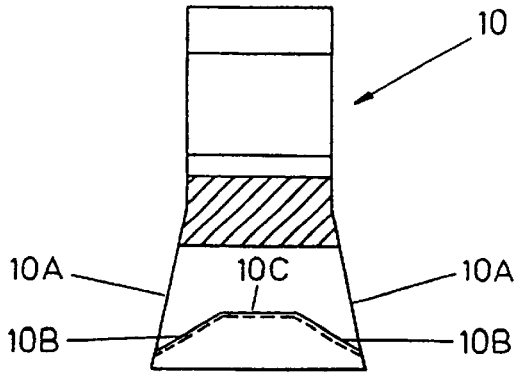
FIG. 8B is a sectional view taken along the line B—B of FIG. 8A.
Figure 9A:
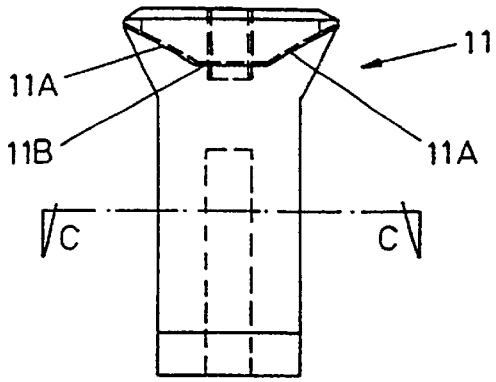
FIG. 9A is a side view of an alternative form of male member, complimentary to the female member illustrated in FIGS. 8A and 8B.
Figure 9B:
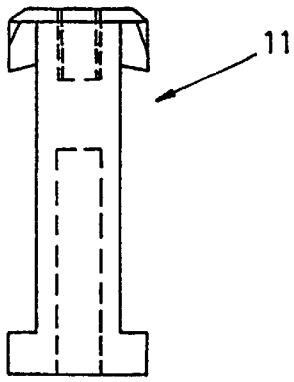
FIG. 9B is an end view of the alternative form of male member shown in FIG. 9A.
Figure 9C:
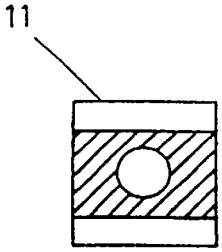
FIG. 9C is a sectional view taken on the line C—C in FIG. 9A.

Each female member 6 is slotted at 6B to receive a respective web 7B and is undercut at 6C (FIG. 6) to receive the head 7A.

The female member is also provided with a web and body portion 6D, by means of which it is anchored in the segment 1.

Figure 4:
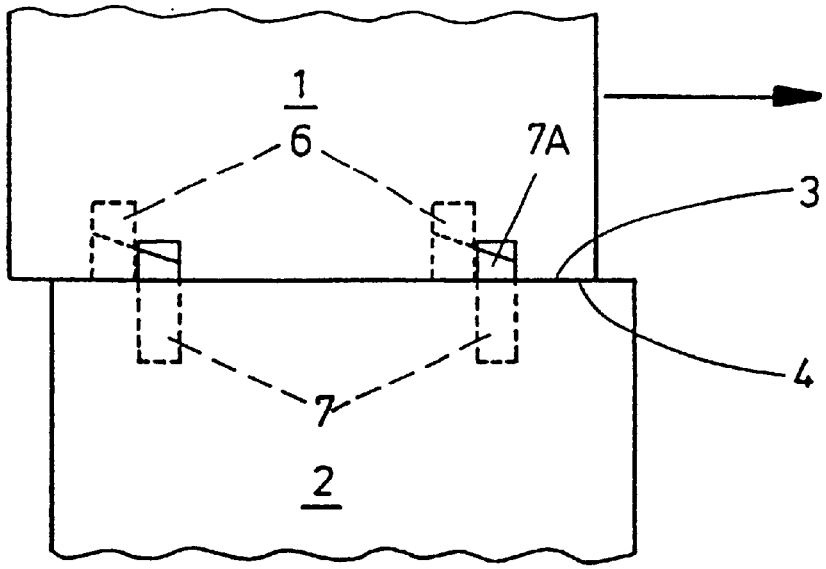
FIG. 4 is a diagrammatic sectional view of the two end faces of the two segments shown located adjacent one another but prior to joining.
Figure 5:
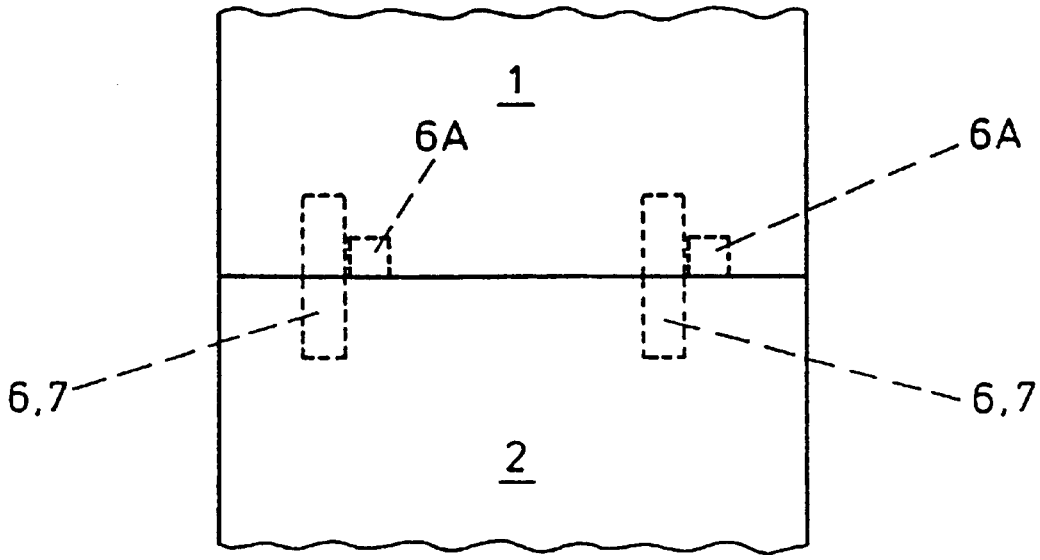
FIG. 5 is a view similar to FIG. 4 but showing the two segments after joining.

FIG. 4 illustrates an initial stage of joining the two segments 1, 2 together. First of all, the two faces 3 and 4 are placed face on so that the recesses 6A of the female members 6 are placed over the heads 7A of the male members 7. Then one segment is moved relatively to the other (in FIG. 4, the segment 1 is shown to be moved, in the direction of the arrow, on the segment 2) so that the position is reached shown in FIG. 5. In a typical tunneling shield, for example, this movement can be achieved by hydraulic rams to force one segment sideways relatively to the other to align them. This movement causes the web 7B of the male member 7 to slide in the slot 6B of the female member 6 so that the head 7A enters the undercut 6C.

To provide firm engagement and tightening of one member relatively to the other, both members 6 and 7 are provided with sloping engagement faces 8, 9, respectively to provide the wedging action by acting to draw the head 7 further into the female member 6 as the web 7B is moved along the slot 6B. The elasticity of the material of the members 6 and 7 and the angle of slope, amongst other things, determine the tenacity of the joint so formed.

Referring to FIGS. 8A and 8B and FIGS. 9A–9C, an alternative construction is illustrated to facilitate entry of the male member from either end of the female member.

The female member 10 is shaped as a double-entry member for the male member 11, the female member 10 being provided with an opening 10A at each end of its slot so as to receive the male member 11 in its undercut from either end of the slot.

As illustrated, the female member 10 has a ramped sloping engagement face 10B, rising from both ends of the slot, with a flat central land 10C.

The complementary male member 11 in the form illustrated is also provided with a ramped engagement face 11A with a flat central land 11B.

Accordingly, engagement of the male member 11 with the female member 10 can be achieved by entry via either end of the slot in the female member and maximum tension between the two components is achieved when the two lands 10C, 11B are face on one another.

What is claimed is:

1. A device for joining two concrete members together, the device comprising a female member for anchoring in one of the concrete members to open at a surface thereof and a male member for anchoring in the other of the concrete members, the female member being slotted and undercut and the male member having a head for mating with the female member in its undercut so as to be held therein by a wedging action; wherein the female member is of elastic material and the male member is of elastic material and the head is joined by a web to a body for anchoring the male member, the web being able to slide in said slot and the head being engageable with the female member in its undercut and at least one of the male and female members has a sloping engagement face to provide said wedging action by acting to draw the head further into the female member as the web is moved along the slot.

2. A device according to claim 1, wherein the male and female members are made from a high grade elastic polymer material.

3. A device according to claim 1, wherein the male and female members are both provided with a said sloping engagement face to provide the wedging action between them.

4. A device according to claim 1, wherein the female member is provided adjacent its slot with an opening to receive the head of the male member so that the head of the male member may be received in the undercut of the female member.

5. A device according to claim 4, wherein the sloping engagement face is provided on the female member and said sloping engagement face extends from one end of the slot to the other, increasing in height of slope from an entry end of the slot towards the other end of the slot.

6. A device according to claim 4, wherein the female member is provided with two of said openings, one at each end of the slot of the female member to receive the head of the male member and being provided with said sloping engagement face, that is ramped, rising from both ends of the slot, with a flat central land.

7. A device according to claim 1, wherein the male member is provided with the sloping engagement face and this sloping engagement face increases in height from one side of the male member that is intended to enter the undercut of the female member first towards the other side of the male member.

8. A device according to claim 1, wherein the male member is provided with the sloping engagement face and this sloping engagement face is ramped with a flat central land.

9. A device according to claim 1, wherein there are a pair of said male members and a pair of said female members for joining the said two concrete members together.

10. A device according to claim 1, wherein the concrete members to be joined together are concrete segments for forming a tunnel lining ring or shaft.

11. A device according to claim 1, wherein said male and female members are designed to be cast in the respective concrete members.

12. A concrete segment joining system comprising two concrete segment members and a device for joining the two concrete segment members together, the device comprising a female member for anchoring in one of the concrete segment members to open at a surface thereof and a male member for anchoring in the other of the concrete segment members, the female member being slotted and undercut and the male member having a head for mating with the female member in its undercut so as to be held therein by a wedging action; wherein the female member is of elastic material and the male member is of elastic material and the head is joined by a web to a body for anchoring the male member, the web being able to slide in said slot and the head being engageable with the female member in its undercut and at least one of the concrete segment members has a sloping engagement face to provide said wedging action by acting to draw the head further into the female member as the web is moved along the slot; and wherein the male member is anchored in one of the concrete segment members and the female member is anchored in a corresponding location in the other of the concrete segment members.

* * * * *